US007720421B2

(12) United States Patent
Snyder

(10) Patent No.: US 7,720,421 B2
(45) Date of Patent: May 18, 2010

(54) APPARATUS AND METHOD FOR PRINTING A SCRATCH-OFF DOCUMENT

(75) Inventor: Trevor James Snyder, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 679 days.

(21) Appl. No.: 11/565,270

(22) Filed: Nov. 30, 2006

(65) Prior Publication Data

US 2008/0131176 A1 Jun. 5, 2008

(51) Int. Cl.
*G03G 15/20* (2006.01)

(52) U.S. Cl. ..... 399/321; 347/100

(58) Field of Classification Search ..... 399/321; 347/100

See application file for complete search history.

(56) References Cited

U.S. PATENT DOCUMENTS

| | | | | |
|---|---|---|---|---|
| 5,704,647 | A | 1/1998 | Desbiens | |
| 5,803,504 | A | 9/1998 | Deshiens et al. | |
| 6,152,029 | A * | 11/2000 | Templeton | 101/35 |
| 6,582,896 | B1 | 6/2003 | Ito et al. | |
| 6,607,864 | B2 | 8/2003 | Serizawa et al. | |
| 6,729,656 | B2 * | 5/2004 | Kubert et al. | 283/100 |
| 6,873,821 | B2 | 3/2005 | Russel et al. | |
| 2005/0141942 | A1 * | 6/2005 | Someno | 400/76 |
| 2006/0262160 | A1 * | 11/2006 | Hara | 347/43 |
| 2007/0281224 | A1 * | 12/2007 | Kirk et al. | 430/18 |
| 2008/0089710 | A1 * | 4/2008 | Lofthus et al. | 399/82 |

OTHER PUBLICATIONS

U.S. Appl. No. 11/421,251, filed May 31, 2006, Kirk et al.

http://www.oberthurusa.com/whitepapers-ensuring.asp; Ensuring It Is All 'Up to Scratch' Oberthur Card Systems Talks of Its' Innovative Printing Techniques for Prepaid Mobile Phone Cards; printed Oct. 10, 2006: 4 pp.

http://www.answerbag.com/g_view.php/16009; What is the silver stuff they use on scratch-off cards and lottery tickets?, printed Oct. 10, 2006; 3 pp.

http://www.answerbag.com/q_view.php/24557; How are scratch-off lottery tickets made?, printed Oct. 10, 2006: 2 pp.

http://www.xerox.com/go/xrx/igen/iGen.jsp?Xcentry=USA &Xlang=en_US&metrics=notrack; The Xerox DocuColor iGen3. The next wave of digital production printing. Xerox iGen3™ Business, printed Mar. 16, 2006, 1 p.

http://www.xerox.com/go/xrx/equipment/product_details.jsp?prodID=DocuColor_iGen3&...; Xerox iGen3™ 110 Digital Production Press, printed Mar. 16, 2006, 2 pp.

* cited by examiner

*Primary Examiner*—Matthew Luu
*Assistant Examiner*—Rut Patel
(74) *Attorney, Agent, or Firm*—Pepper Hamilton LLP

(57) ABSTRACT

An apparatus that includes a first print engine positioned to print front side information on a base material. The first print engine further includes a multi-color print head having a pile height leveling ink delivery system. A fuser is positioned to affix the front side information on the base material, and a second print engine positioned to print a removable scratch-off layer covering at least part of the front side information after the fuser affixes the front side information.

20 Claims, 7 Drawing Sheets

APPARATUS AND METHOD FOR PRINTING A SCRATCH-OFF DOCUMENT

CROSS-REFERENCE TO RELATED APPLICATIONS

Not applicable

STATEMENT REGARDING FEDERALLY SPONSORED RESEARCH

Not applicable.

NAMES OF PARTIES TO A JOINT RESEARCH AGREEMENT

Not applicable.

SEQUENCE LISTING

Not applicable.

BACKGROUND

1. Technical Field

The disclosed embodiments generally relate to the field of printing and more particularly, a printing apparatus and method for printing a scratch-off document.

2. Description of the Related Art

Scratch-off type documents are used in many applications. For example, instant lottery tickets are printed with data that is covered by a scratch-off material. When the scratch-off material is removed by rubbing with a coin, fingernail, or other object, the data under the scratch-off coating is revealed. In addition to lotteries, other such documents are often used for other games, such as retail store contests or product give-aways.

The production of scratch-off documents involves a complex printing application, requiring high volume, low cost printing and numerous areas of variable data. Areas of variable data include, for example, winning indicia, number marking and bar code generation. It may also require a release coating and removable scratch-off printing for the scratch-off layer.

The scratch-off material in a scratch-off document must adhere to the base material sufficiently so that it does not rub off in ordinary handling, but so that it is easy to rub off with a scratching object such as a coin or fingernail. Scratch-off documents are traditionally produced using a preprinted document in which a wax-like coating or film is applied over the data that is desired to be hidden. The application of wax-like coatings requires the use of additional or specialized hardware, thus increasing the associated costs and maintenance associated with producing the scratch-off ticket.

The disclosure contained herein describes attempts to address one or more of the problems described above.

SUMMARY

Embodiments herein include an apparatus that may have a first print engine, which may be positioned to print front side information on a base material. The first print engine may further comprise a multi-color print head that may comprise a pile height leveling ink delivery system. An apparatus may have a fuser positioned to affix the front side information on the base material. In embodiments, a second print engine may be positioned to print a removable scratch-off layer covering at least part of the front side information after the fuser affixes the front side information.

In another embodiment, the apparatus may have a pile height leveling ink delivery system that comprises a clear ink delivery system. Other embodiments may have a pile height leveling ink delivery system that comprises a white opaque ink delivery system.

In still a further embodiment, the apparatus may have the first print engine positioned to also print back side information on the base material. For other embodiments, a third print engine may be positioned to print back side information on the base material. A fuser may also be positioned to affix the back side information.

In embodiments, the first, second, and/or third print engines may be selected from the group consisting of an offset printer, a direct printer, a laser printer, a solid ink printer, a xerographic printer, and an inkjet printer.

Still another embodiment includes a method that may include printing front side information on a first side of a base material. The front side information may include a portion to be covered. A further embodiment may include printing the portion to be covered by printing a leveling ink, and printing a plurality of colored ink contiguous with the leveling ink, so that a combined pile height of the leveling ink and the colored ink is substantially level over the portion to be covered. A removable scratch-off layer may be printed over the portion of the front side information to be covered, so that the portion of the front side information to be covered is not visible through the removable scratch-off layer.

In embodiments, printing the leveling ink comprises printing a clear ink. In other embodiments, printing the leveling ink comprises printing an opaque white ink.

A further embodiment may include printing back side information on a second side of the base material.

Another embodiment may comprise fusing the leveling ink and the colored ink of the portion to be covered of the front side information prior to printing the removable scratch-off layer.

In some embodiments, printing the removable scratch-off layer comprises printing with at least one opaque ink. In other embodiments using opaque ink, printing the removable scratch-off layer may include printing a random pattern or printing an image.

In still a further embodiment, a method may include printing a leveling ink. A further embodiment may include printing colored ink having a plurality of colors contiguous with the leveling ink, so that a combined pile height of the leveling, ink and the colored ink is substantially level.

In yet another embodiment, printing of a leveling ink may be performed before the printing of colored ink, and the method further may further include fusing the leveling ink and the colored ink to a base material.

In still yet another embodiment, printing the colored ink may be performed before printing the leveling ink, and may further include fusing the leveling ink and the colored ink to a base material.

Another method embodiment may include printing a removable scratch-off layer over at least a portion of the leveling ink and the colored ink,

DETAILED DESCRIPTION

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope. For example, as used herein and in the appended claims, the singular forms "a," "an," and "the" include plural references unless the context clearly dictates otherwise In addition, the word "comprising" as used herein is intended to mean "including but not limited to." Unless defined otherwise, all technical and scientific terms used herein have the same meanings as commonly understood by one of ordinary skill in the art.

Scratch off documents may serve for example as a promotional tool, such as in a sweepstake or a contest, or as a gambling device, as in state controlled "instant lottery" tickets. The printing of a scratch-off document requires printing information on the front of the ticket and subsequently printing a removable scratch-off layer over the information to be covered. In addition, a scratch-off ticket may have additional material printed on the reverse or back side.

Figure 1A:
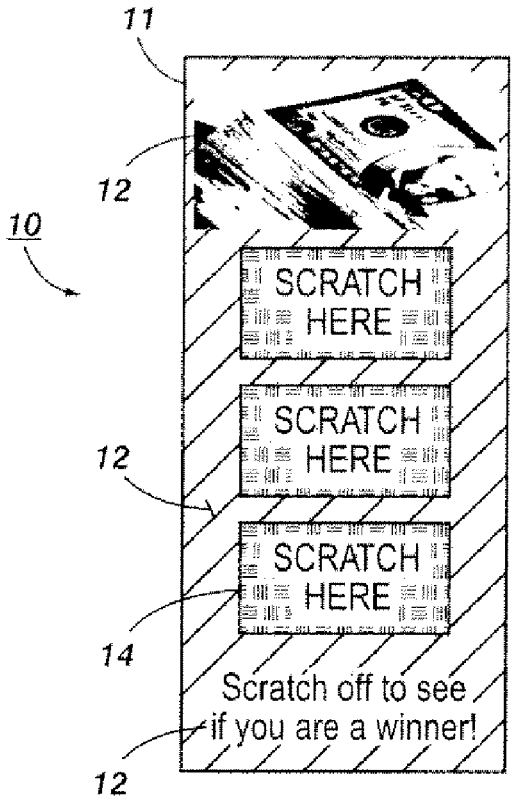
FIGS. 1A and 1B depict an example of a front side of a lottery or promotional scratch-off ticket or document before and after "scratching", respectively.
Figure 1B:
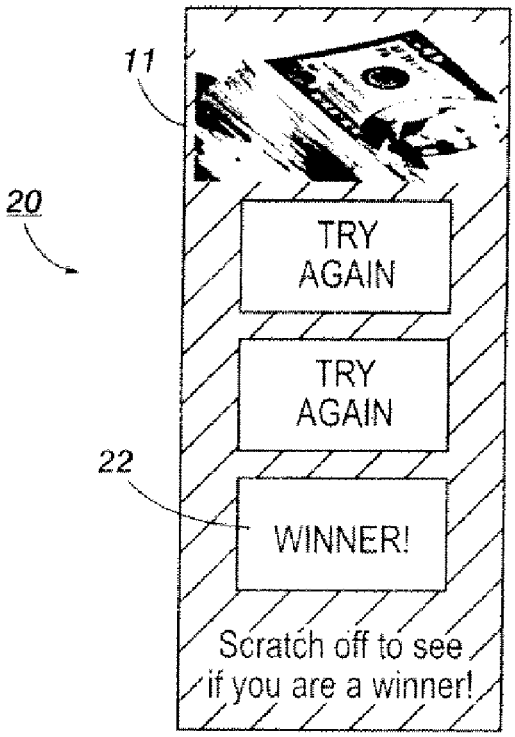

An example of a front side of a scratch-off document prior to scratching 10, or prior to removing the removable scratch-off layer, is depicted in FIG. 1A. An example of a front side of a scratch-off document after scratching 20, or after removal of the removable scratch-off layer, is depicted in FIG. 1B. The front side of a scratch off document prior to scratching 10 includes a base material 11 that has been printed with front side information 12. The base material 11 may comprise paper, cardboard, plastic or other material. The phrase "front side information" 12, as used herein, includes any graphics, images, numbers, letters, text, instructions, bar codes, winning/losing indicia, and anything that is printed on the front or scratch-off side of the document, but not including the removable scratch-off layer 14.

Figure 2:
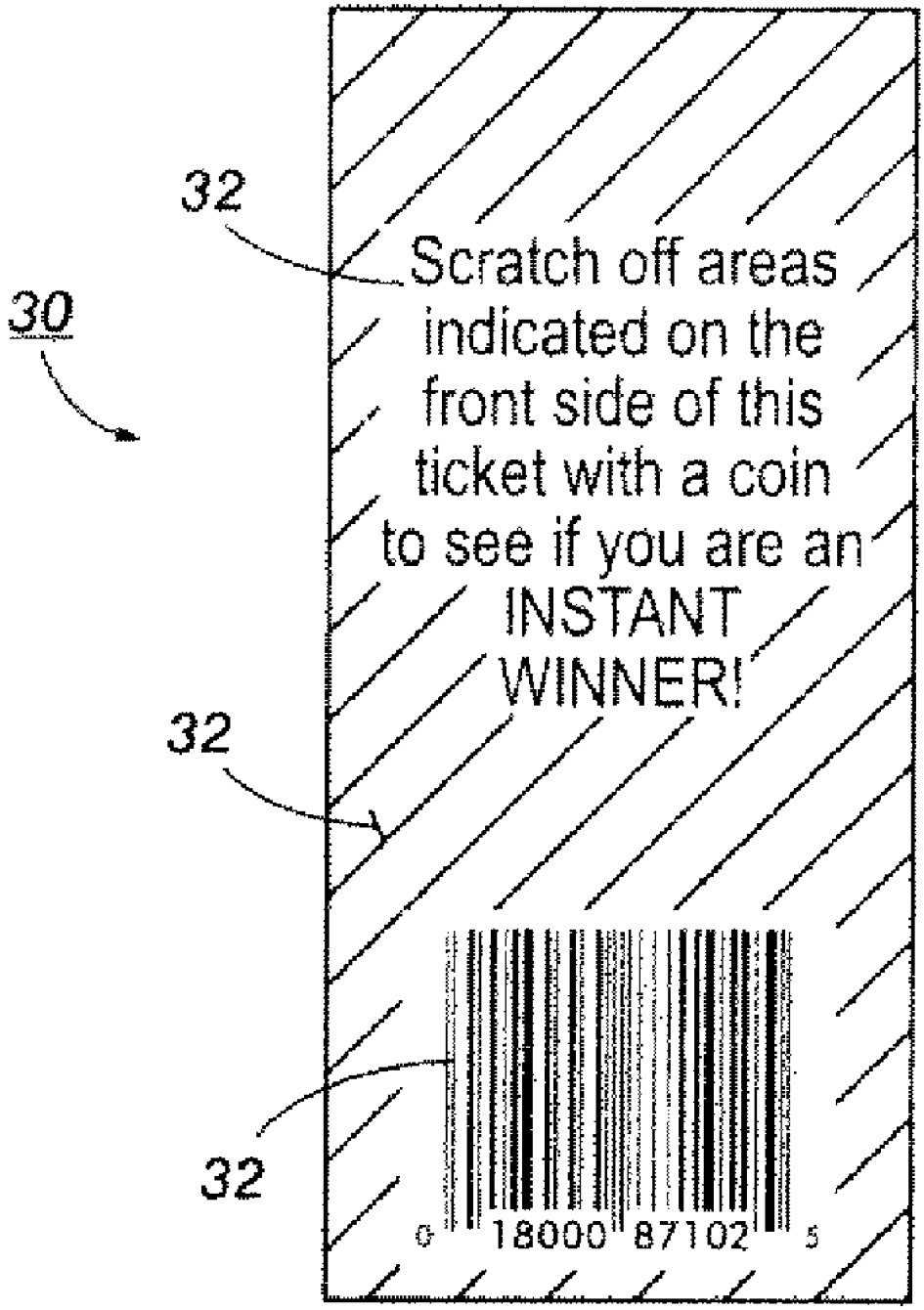
FIG. 2 depicts a back side of a lottery of promotional scratch-off document.

The removable scratch-off layer 14 may cover part one or more parts of the front side information 12, and that part of the front side information, such as for example, winning/losing indicia or promotional information, or collectively, the portion to be covered 22, is not visible through the removable scratch-off layer. The removable scratch-off layer 14 may further contain graphics, text, instructions, or other printings An embodiment of a back side of a scratch-off ticket 30 is depicted in FIG. 2. The back side of a scratch off document 30 optionally includes back side information 32. The phrase "back side information" 32, as used herein, includes any graphics, images, numbers, letters, text, instructions, bar codes, and anything that is printed on the back side of the document.

Exemplary embodiments of an apparatus for making a lottery or promotional scratch-off ticket or document comprise various print engines. The phrase "print engine" as used herein refers to the main hardware components of a printer or copier that actually perform the printing. Examples of hardware components of a print engine may include ink reservoirs, ink delivery systems, print head assemblies, drums, belts, backup rollers, and others that are familiar to those of ordinary skill in the art.

Figure 3:
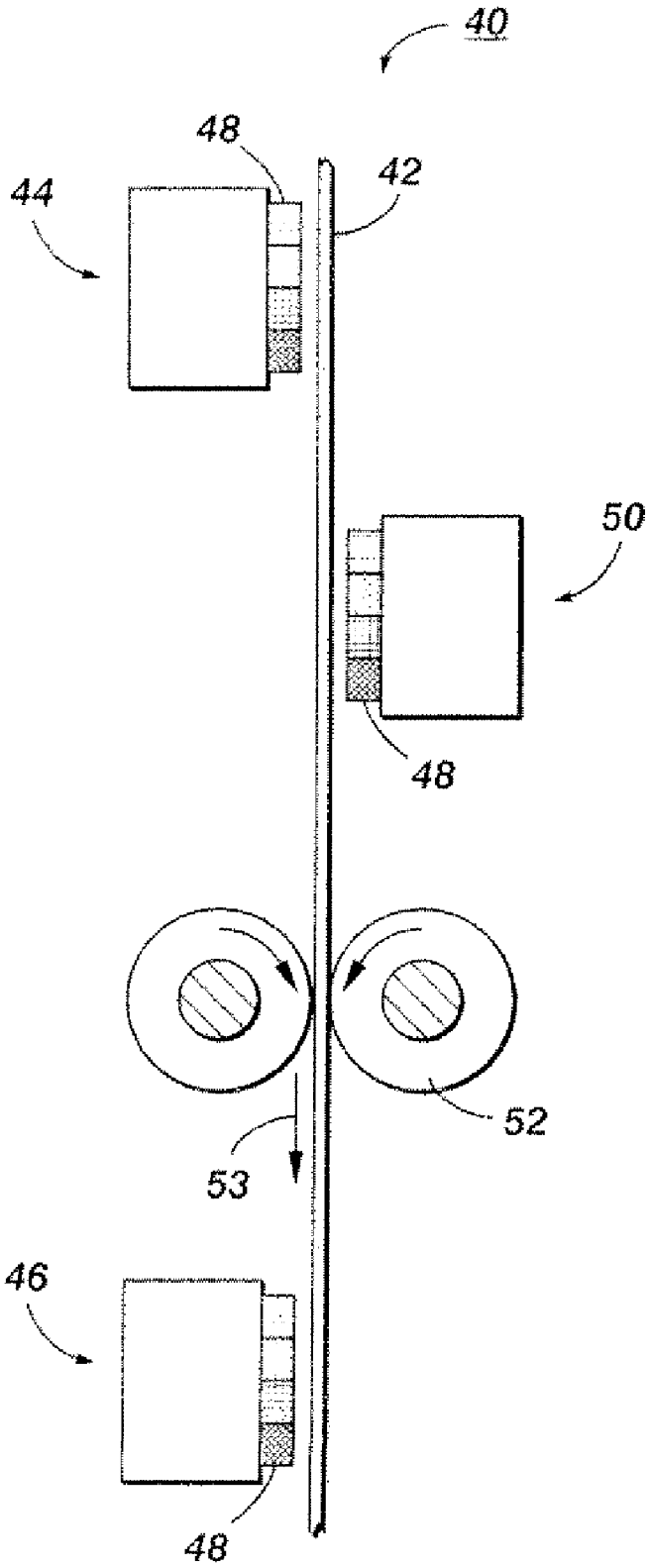
FIG. 3 depicts an embodiment of an exemplary apparatus for making scratch-off documents comprising direct print engines comprising either solid ink or liquid-based ink.

FIG. 3 represents a direct print embodiment of an apparatus for printing a scratch-off document 40, wherein the ink is directly printed to the scratch off document 42. Direct ink printing includes direct solid ink printing, where the ink is originally in solid form and is melted for printing; direct inkjet printing with oil and/or water based inks; and any other direct printing method known now or hereinafter by one of ordinary skill in the art.

Offset print engines are also included in embodiments herein. Offset print engines are those where the ink or toner is applied to a drum, belt, or other substrate, and then transferred to the paper or material to be printed. Offset print engines include xerographic, laser, light emitting diode (LED), offset solid ink, offset inkjet, and any other offset printing method known now or hereinafter to one of ordinary skill in the art. It is recognized that any combination of print engines in an apparatus are within the scope of embodiments of the apparatus herein. Further, the phrase "print engine" used herein, without any further qualifiers, refers to all or any of the various print engines mentioned herein, and is not meant to be limited to any specific type of print engine.

Referring back to FIG. 3, an embodiment of an apparatus for printing a scratch-off document may include a first print engine 44, comprising a direct print engine, for printing front side information, and a second print engine 46, comprising a direct print engine, for printing a removable scratch-off layer. Each print engine 44, 46 may comprise a print head assembly or print head 48. The first print engine 44 is positioned to print front side information on a base material. The first print engine 44 may further include a multi-color print head 48 comprising a pile height leveling ink delivery system (not shown).

Still referring to FIG. 3, the first print engine 44 may also be used for printing back side information. In an embodiment that uses first print engine 44 to print the back side information, the apparatus may include a duplex path and/or inverter (not shown) to present the back side of the document to first print engine 44. Methods of printing two-sided, or duplex, documents with one print engine are known to those skilled in the art and need not be elaborated further herein. Alternatively, a third print engine 50 may be used for printing back side information.

Figure 4:
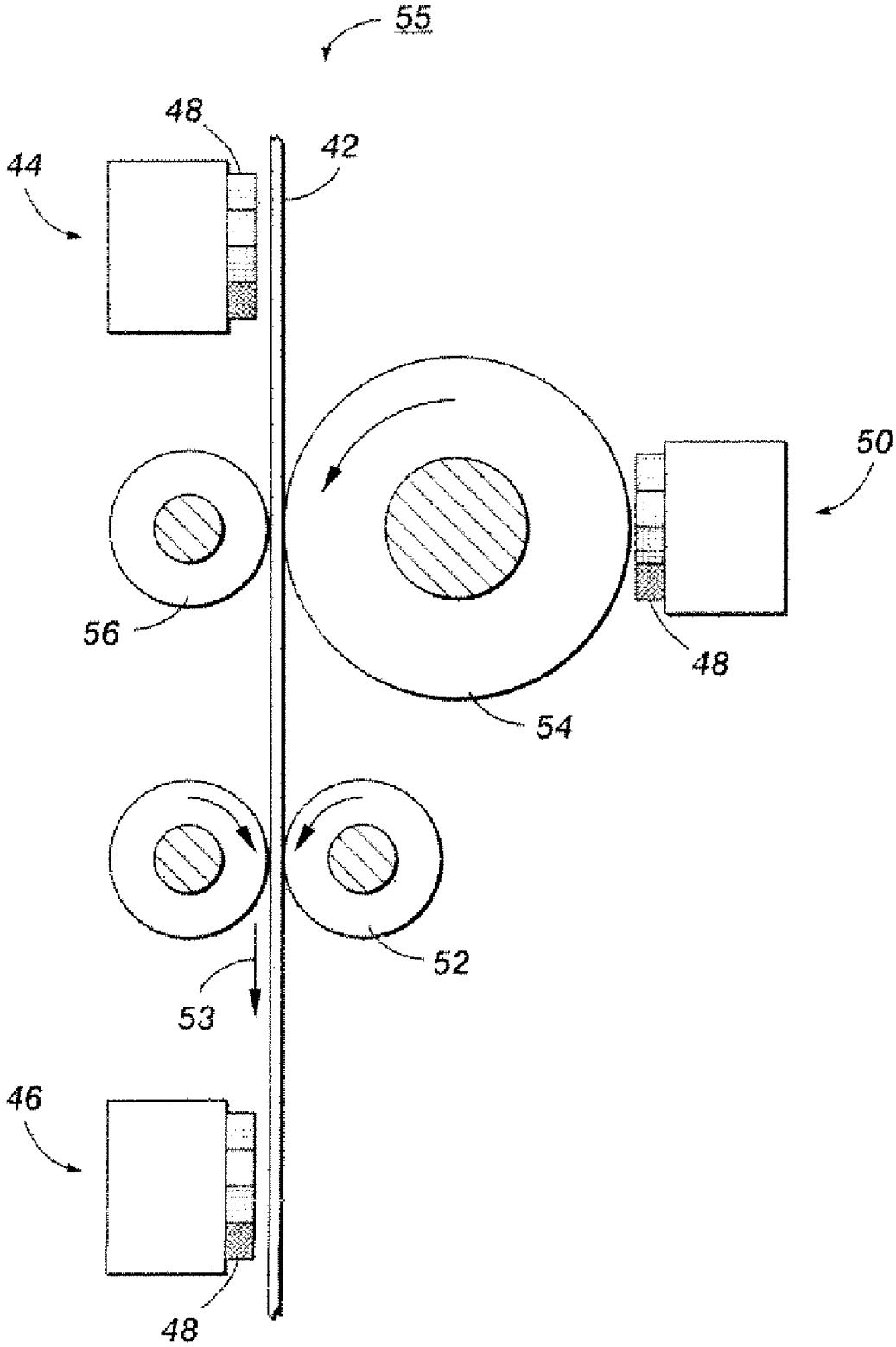
FIG. 4 depicts an embodiment of an exemplary apparatus for making scratch-off documents comprising a combination of direct and indirect print engines comprising either solid ink or liquid-based ink.
Figure 5:
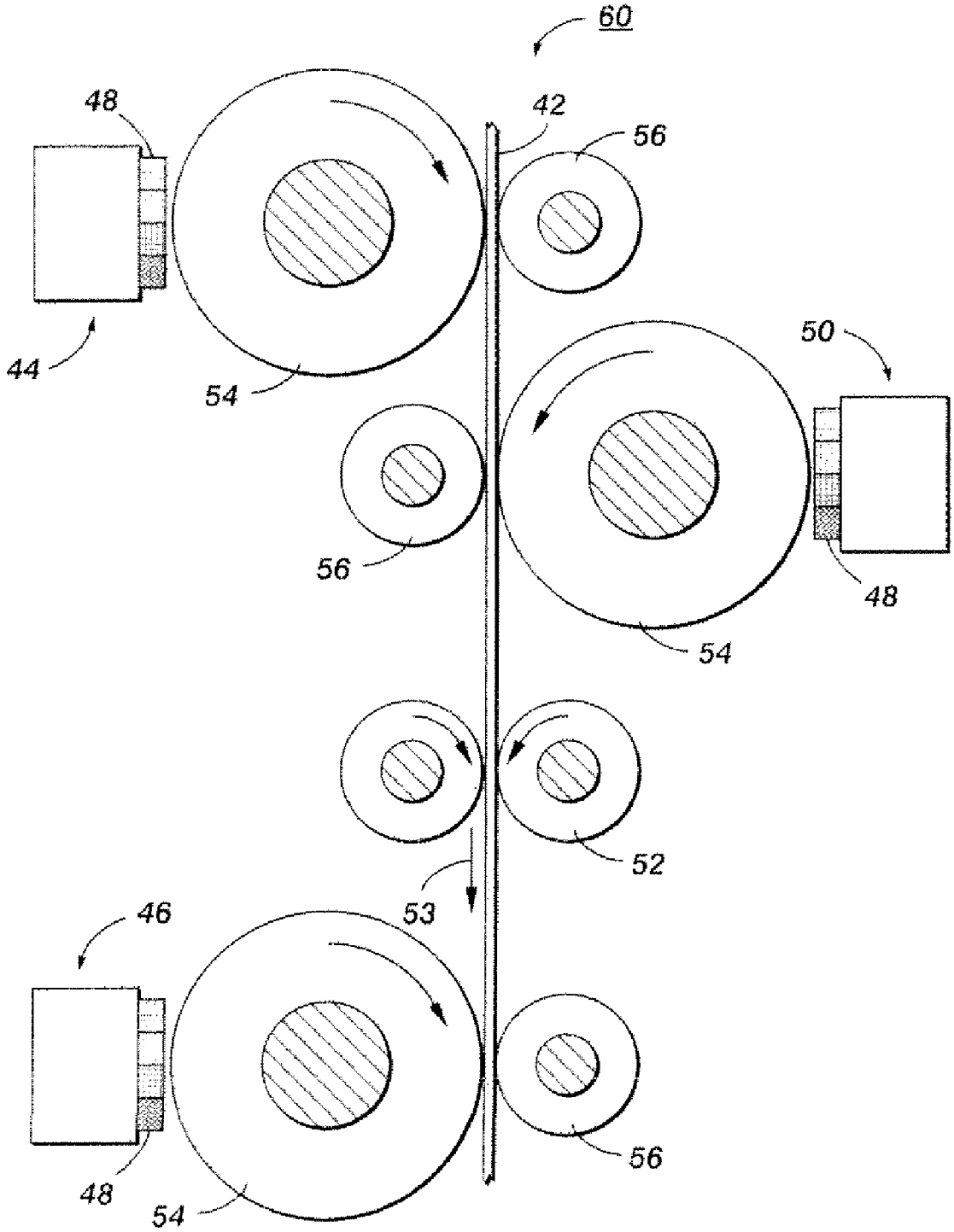
FIG. 5 depicts an embodiment of an exemplary apparatus for making scratch-off documents comprising indirect print engines comprising either solid ink or liquid-based ink.

Referring now to FIGS. 3-5, a scratch-off document may proceed through an apparatus in a direction indicated by arrow 53. Embodiments of an apparatus for printing scratch off documents may include having at least one fuser 52 after any or all of the first, second, or third print engines 44, 46, 50. A fuser 52 may be used to soften the ink or toner of the front side information and/or back side information so that the ink or toner becomes fused into the base material, so that it is not easily removed, and it is essentially permanently affixed to the base material. Fusing methods may include hot roll fusing, cold roll fusing radiant fusing, solvent fusing, or any method of fusing that is now or hereafter known to one skilled in the art of xerography. A fuser 52 may comprise a halogen heating lamp, a Teflon®-coated fusing roller, and a pressure roller. Any fuser 52 known now or hereinafter to one of ordinary skill in the art is encompassed in the embodiments herein. In embodiments depicted in FIGS. 3-5, a fuser 52 is positioned in the apparatus so that it permanently affixes the ink or toner comprising the front side information, whereupon the scratch-off layer is applied but not fused. Other orientations of a fuser or fusers are possible.

In an embodiment, a fuser 52 may also apply oil or some release agent that would facilitate removal of the scratch-off layer. Alternatively, a separate release agent application station (not shown) may be included. In an embodiment, the fuser 52 may comprise an ultraviolet (UV) curing station that could be used to cure UV curable inks.

As indicated previously, any combination of print engines are within the scope of embodiments of the apparatus herein. FIG. 4 depicts an exemplary apparatus comprising a combination of direct print engines and offset print engines 55, whereas FIG. 5 depicts an apparatus comprising all offset print engines 60. In FIG. 4, the first print engine 44 and the second print engine 46 comprise direct print engines, whereas the third print engine 50 comprises an offset print engine. An offset print engine may comprise for example a drum 54, a backup roll 56 and any other hardware component for offset printing known now or hereinafter to one skilled in the art.

It is stressed that the embodiments of the apparatus depicted in FIGS. 3-5 are exemplary and are not meant to limit embodiments of the apparatus to the depicted configurations. For example, al offset print engine may be used for a first print engine 44 and/or a second print engine 46. In another embodiment, different types of ink may be provided in the different print engines. For example, the ink from the first print engine 44 may be fiat ink so that the scratch-off ink, which may be raised ink or another type of flat ink, gives good coverage when applied by the second print engine 46. In another embodiment, an offset process may be used with solid ink for the second print engine 46 printing of the scratch-off layer. Embodiments of an apparatus herein can include any combination of any type of print engine that is effective in printing a scratch-off document.

As used herein, the word "ink" includes toners, solid ink, oil based liquid ink, water based liquid ink, and any material known now of hereafter to one of ordinary skill in the at, that may be used with the various types of print engines.

In an embodiment, a solid ink may comprise Phaser 8500/8550—Solid Ink from the Xerox® Corporation.

Solid ink compositions are known. For example, but not limited to, solid ink compositions are disclosed in U.S. Pat. No. 6,906,118, the disclosure of which is totally incorporated herein by reference. U.S. Pat. No. 6,906,118 discloses solid inks that include hydrogen bonded dimers, oligomers, or polymers. U.S. Pat. No. 6,306,203, the disclosure of which is totally incorporated herein by reference, discloses a solid ink based that includes non-polymeric ester compound ink vehicles. U.S. Pat. App. Pub. No. 20060132570, the disclosure of which is totally incorporated herein by reference, discloses a solid ink with a radiation curable oil soluble compound.

In an embodiment, an ink may comprise iGen3® Digital Production Press—Bulk Toner from the Xerox® Corporation.

Toner compositions are known, such as those disclosed in U.S. Pat. No. 4,543,313, the disclosure of which is totally incorporated herein by reference. In U.S. Pat. No. 4,891,293, the disclosure of which is totally incorporated herein by reference, there are disclosed toner compositions with thermotropic liquid crystalline copolymers, and wherein sharp melting toners are illustrated. Moreover, in U.S. Pat. No. 4,973,539, the disclosure of which is totally incorporated herein by reference, there are disclosed toner compositions with crosslinked thermotropic liquid crystalline polymers.

Low fixing toners comprised of semi-crystalline resins are also known, such as those disclosed in U.S. Pat. No. 5,166,026, the disclosure of which is totally incorporated herein by reference, and wherein toners comprised of a semi-crystalline copolymer resin, such as poly(alpha-olefin) copolymer resins, with a melting point of from about 30° C. to about 100° C., and containing functional groups comprising hydroxy, carboxy, amino, amido, ammonium or halo, and pigment particles, are disclosed. Similarly, in U.S. Pat. No. 4,952,477, the disclosure of which is totally incorporated herein by reference, toner compositions comprised of resin particles selected from the group consisting of semi-crystalline polyolefin and copolymers thereof with a melting point of from about 50° C. to about 100° C., and containing functional groups comprising hydroxy, carboxy, amino, amido, ammonium or halo, and pigment particles, are disclosed. Similarly, in U.S. Pat. No. 4,952,477, the disclosure of which is totally incorporated herein by reference, toner compositions comprised of resin particles selected from the group consisting of semi-crystalline polyolefin and copolymers thereof with a melting point of from about 50° C. to about 100° C. and pigment particles are disclosed. In U.S. Pat. No. 4,990,424, the disclosure of which is totally incorporated herein by reference, toners including a blend of resin particles containing styrene polymers or polyesters, and components selected from the group consisting of semi-crystalline polyolefin and copolymers thereof with a melting point of from about 50° C. to about 100° C. are disclosed. Fusing temperatures of from about 250° F. to about 330° F. (degrees Fahrenheit) are reported.

Low fixing crystalline based toners are disclosed in U.S. Pat. No. 6,413,691, the disclosure of which is totally incorporated herein by reference, and wherein a toner including a binder resin and a colorant, the binder resin containing a crystalline polyester containing a carboxylic acid of two or more valences having a sulfonic acid group as a monomer component, is illustrated. The crystalline resins of the '691 patent are believed to be opaque, resulting in low projection efficiency.

Crystalline based toners are disclosed in U.S. Pat. No. 4,254,207, the disclosure of which is totally incorporated herein by reference. Low fixing toners comprised of crosslinked crystalline resin and amorphous polyester resin are illustrated in U.S. Pat. Nos. 5,147,747 and 5,057,392, the disclosures of which are totally incorporated herein by reference, and wherein the toner powder is comprised, for example, of polymer particles of partially carboxylated crystalline polyester and partially carboxylated amorphous polyester that has been crosslinked together at elevated temperature with the aid of an epoxy novolac resin and a cross-linking catalyst.

Also of interest are U.S. Pat. Nos. 6,383,205; 6,017,671; and 4,385,107, the disclosures of which are totally incorporated herein by reference, U.S. Patent Pub. No. 2004/0142266, herein incorporated by reference in its entirety, describes a toner comprised of a branched amorphous sulfonated polyester resin, a crystalline sulfonated polyester resin, a colorant and an optional wax. In the toner of the '266 Publication, the crystalline resin displays or possesses a melting temperature of from about 50° C. to about 110° C.; the amorphous branched resin has an average molecular weight of about 2,000 to about 300,000 grams per mole; and the crystalline resin displays an average molecular weight of about 1,000 to about 50,000 grams per mole.

U.S. Pat. No. 6,500,594, herein incorporated by reference in its entirety, describes an electrophotographic developer comprising a toner and a carrier, wherein the toner contains a colorant and a crystalline resin, and wherein the carrier has a nitrogen-containing resin coating. The toner of the '594 Patent preferably has specific rheological properties including certain dynamic viscosity characteristics. The toner has a storage elastic modulus (G') of 1×106 Pa or more and a loss elastic modulus (G") of 1×106 Pa or more at the angular frequency of 1 rad/sec and at 30° C. The elastic properties are related to toner hardness, stability, and fusing temperature. U.S. Pat. Nos. 6,582,896 and 6,607,864, herein incorporated by reference in their entirety, also describe toners having similar rheological characteristics.

Oil and water based inks for inkjet printers that may be used in embodiments herein are well known to those skilled in the art, and need not be elaborated upon.

Referring to FIGS. 3-5, a print head 48 may comprise a multi-color print head. In another embodiment a multi-colored print head may include a leveling ink delivery system (not shown), In an embodiment, a leveling ink may include a clear ink, a transparent white or near-white ink, or an opaque white or near-white ink. In another embodiment, a four-color print head may comprise delivery systems for a cyan ink, a magenta ink, a yellow ink, and a leveling ink, in place of the typical cyan ink, magenta ink, yellow ink, and black ink (CMYK) configuration. In another embodiment, a five-color print head may be used and may comprise delivery systems for cyan ink, magenta ink, yellow ink, black ink (CMYK), and a leveling ink. In yet another example, a print head 48 may be configured for black and white printing. It is recognized that more print heads may be used, for example to increase the gamut of color or resolution, and this would still be within the scope of the embodiments herein.

In another embodiment, the print head 48 of the second print engine 46 that is used for printing the scratch-off layer may comprise a delivery system for a single ink. An ink used for printing the scratch-off layer may include at least one opaque ink.

Figure 6:
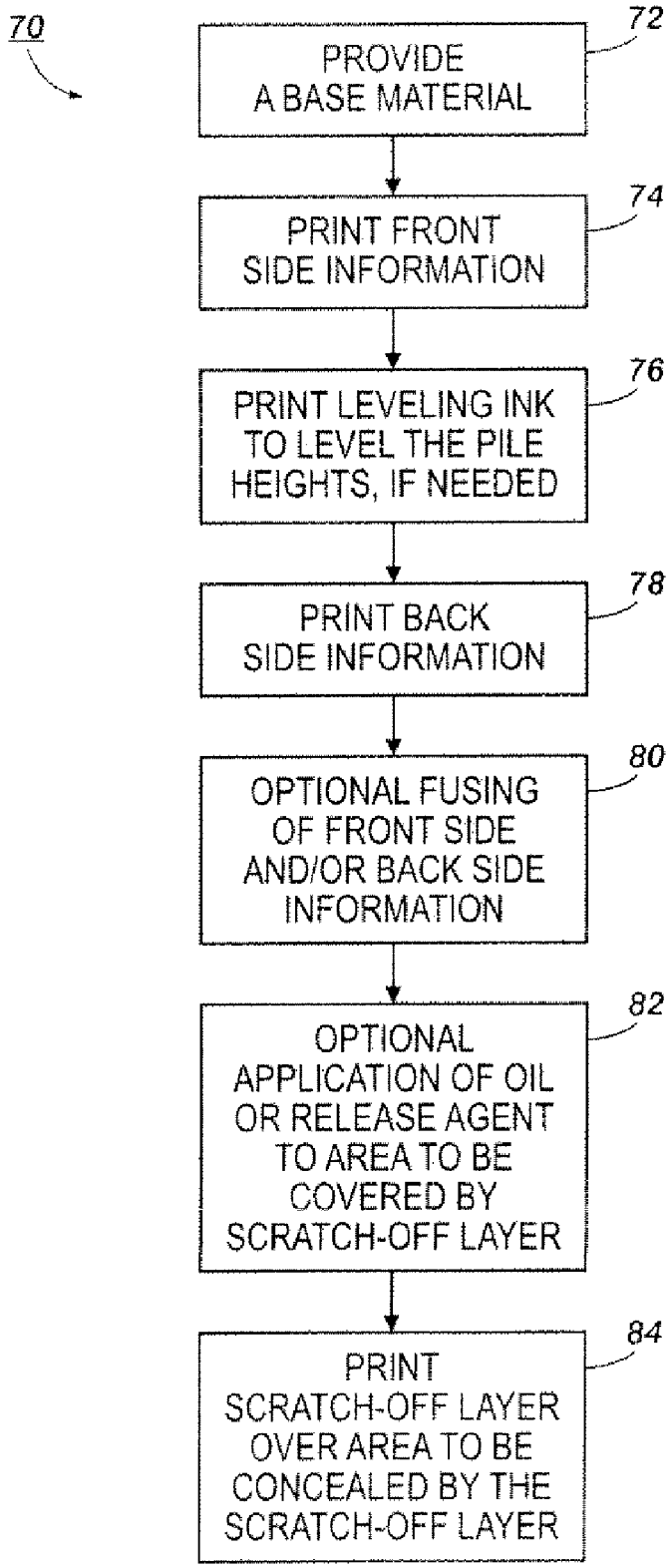
FIG. 6 is a flow diagram of an exemplary method of making a scratch-off document.

FIG. 6 depicts an exemplary method of making a lottery or promotional scratch-off ticket or document 70. A method embodiment 70 may include providing a base material 72, and printing front side information on the base material 74. The base material may comprise paper, cardboard, plastic, or other materials. In an embodiment, the front side information may comprise a plurality of colors, and the colors may have essentially equivalent pile heights. This may be an embodiment where liquid or inkjet inks are used.

Pile heights relate to number of pixels per space for each color ink. Primary colors, such as cyan, magenta and yellow may comprise one pixel per space of base material. To get other colors, additional pixels of the primary colors are used. For liquid inks and inkjet inks, pile heights for each color may not vary. However for solid inks and toners, the entire gamut of colors comprises various numbers of pixels per space of base material, which results in various pile heights of the ink or toner when printed on the substrate. The variation of pile height for each color may make it difficult to mask the indicia that are to be covered by the scratch-off layer because a pattern of the indicia may be observable ill the scratch-off layer. Also, the ink from the first print engine 44 may itself be used as part of the release mechanism for the scratch-off layer. In these embodiments, a uniform and complete coverage of ink is needed, both in places for winning indicia and those areas outside the indicia.

An embodiment herein includes a print engine for printing that provides a leveling ink delivery system that substantially levels the pile heights of the entire gamut of colors of ally printing system. Referring back to FIG. 6, in an embodiment, the front side information pile height may vary after printing multiple colors, for example when using solid inks or toners. In this instance, a leveling ink could be printed 76 to level the pile heights. A clear transparent leveling ink could be printed prior to printing the colored ink, after printing the colored ink, or during printing of the colored ink. In an embodiment that includes leveling ink in one of the printing heads, printing the leveling ink may be done at the same time as printing the colored ink. In an embodiment the colored ink may be contiguous with the leveling ink. The colored ink may be on top of the leveling ink, below the leveling ink, or substantially adjacent to the leveling ink on the substrate material. For embodiments using clear transparent ink as the leveling ink, the clear transparent ink may be on top of the colored ink, below the colored ink, or substantially adjacent to the colored ink. In another embodiment, the leveling ink may be a white or near-white opaque ink. For embodiments using white opaque ink as the leveling ink the white opaque ink may be substantially underneath the colored ink. In embodiments, the combined pile height of the leveling ink and the colored ink for all of the front side information in the portion to be covered is substantially level or equal for all gamut colors. For colors that may have the largest pile height out of all the colors in the gamut, for example, but not limited to a composite black, no leveling ink may be required to substantially level the pile height with respect to other colors in the gamut. A composite black color may be obtained, for example, by using all of the primary colors available in the printing system. Equivalent or level pile heights ensure that an image of the front side information in the portion to be covered cannot be detected through the removable scratch-off layer.

In an embodiment, back side information may be printed 78. Optionally, the front side and/or the back side information may be fused 80. Optionally, the front side information that is to be covered with the scratch-off layer may be covered with an oil or release agent 82. In an embodiment, a removable scratch-off layer may be printed 84 covering at least part of the front side information, so that part of the front side information that is covered is not visible through the removable scratch-off layer. Optionally, the removable scratch-off layer is printed without fusing. It is recognized that the order of the printing steps may be varied, with the exception that the portion of the front side information that will be covered by the scratch-off layer needs to be printed prior the printing the scratch-off layer.

Figure 7A:
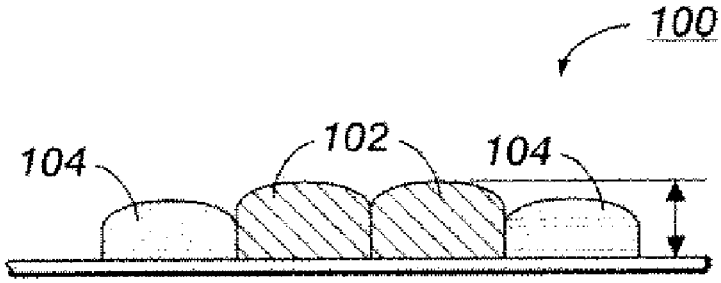
FIG. 7A PRIOR ART
FIG. 7A depicts differences in pile heights between printed colors for color dry ink and color xerographic processes.

As described previously, a further embodiment may include printing the front side information using a multicolor print head comprising a leveling ink delivery system. It is known to those skilled in the art that color printing using laser, xerographic, and solid ink technologies results in different pile heights between the colors. This is depicted in FIG. 7A. The traditional prior art cyan, magenta, yellow and black (CMYK) method of printing 100 results in different pile heights for each color printed with color solid inks or color toners. For example, a secondary color 102, such as red, blue, or green, may have a pile height that is twice as tall as a primary color 104, such as cyan, magenta, and yellow. This may be problematic for printing the indicia that is to be covered by the scratch-off layer in that the difference in pile heights may allow an image of the indicia to be seen through the scratch-off layer.

Figure 7B:
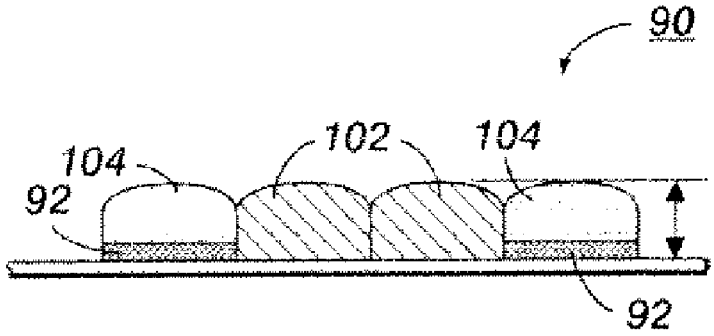
FIG. 7B depicts the use of leveling ink to level pile heights of different color printed inks.

Now referring to FIG. 7B, an embodiment where a leveling ink replaces black ink in the CMYK system 90 is presented.

Leveling ink 92, that may replace the black ink in the CMYK system, may be used to level the pile heights of each of the plurality of colors. The leveling ink 92 may be a clear ink, a white or near-white transparent ink, or a white or near-white opaque ink. In some embodiments, the leveling ink could be comprised of two drops or another small amount of the primary color ink, for example, but not limited to two drops of cyan or two drops of magenta. Where a leveling ink replaces black ink, black print is still available in the form of composite black comprising a combination of the cyan, magenta., and yellow inks. Since the pile heights are leveled through the use of a leveling ink, the image of the indicia underneath the scratch-off layer is not visible or evident due to differing pile heights.

The additional benefits of using a clear ink are that it constrains all of the pixels on the page and provides enhanced image quality. This allows for creation of front side and back side information with photographic quality. In addition, the use of clear ink would allow the reduction of the number of print heads required for adequate image quality. For example, it may allow only 150 dots per inch (dpi) x-resolution versus 300 dpi.

An exemplary embodiment may include using at least one opaque ink to print the removable scratch-off layer. In another exemplary embodiment, using at least one opaque ink, the removable scratch-off layer may be printed in full color. Another embodiment using at least one opaque ink for the scratch-off layer may include printing the removable scratch-off layer with a random pattern. For example, a random pattern can be generated in the removable scratch-off layer by printing less than 100% fill in random areas of the scratch-off layer.

Current cyan, magenta, and yellow toners and inks are designed to be transparent. This is done to make good overhead transparencies. If the primary colors were opaque, they would all show up as black on a transparency. Currently, a special paper is used for scratch-off documents and tickets to prevent the user from being able to see through the paper and identify a winning ticket. Opaque inks and toners would allow the use of less expensive paper, and fewer steps in the overall process. Also, the use of opaque inks would allow both the front side information and the removable scratch-off layer to be created in full color. In still a further embodiment the removable scratch-off layer with at least one opaque ink may comprise an image, graphic, or text.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following, claims.

What is claimed is:

1. An apparatus, comprising a first print engine positioned to print front side information comprising ink of a first color on a base material, wherein the first print engine comprises a solid ink printer; and wherein the first print engine further comprises a multicolor print head comprising a pile height leveling ink delivery system to print a solid leveling ink of at least a second color to level one or more pile heights associated with the ink of a first color;

a fuser positioned to affix the front side information on the base material; and a second print engine positioned to print a removable scratch-off layer covering at least part of the front side information after the fuser affixes the front side information.

2. The apparatus of claim 1 wherein the pile height leveling ink delivery system comprises a clear ink delivery system.

3. The apparatus of claim 1 wherein the pile height leveling ink delivery system comprises a white opaque ink delivery system.

4. The apparatus of claim 1, wherein the first print engine is positioned to also print back side information on the base material.

5. The apparatus of claim 1, further comprising a third print engine positioned to print back side information on the base material.

6. The apparatus of claim 5, further comprising a fuser positioned to affix the back side information.

7. The apparatus of claim 1, wherein the second print engine comprises a solid ink printer.

8. The apparatus of claim 5, wherein the third print engine is selected from the group consisting of an offset printer, a direct printer, a laser printer, a solid ink printer, a xerographic printer, and an inkjet printer.

9. A method, comprising:

printing a plurality of solid colored inks having a plurality of colors in a plurality of locations on a base material, and printing a solid leveling ink, over or under the plurality of solid colored inks in a portion of the plurality of locations so that a combined pile height of the solid leveling ink and the solid colored inks is substantially level.

10. The method of claim 9, wherein the printing of a solid leveling ink is performed before the printing of the solid colored inks, and wherein the method further includes fusing the solid leveling ink and the solid colored inks to the base material.

11. The method of claim 9, wherein the printing of the solid colored inks is performed before the printing of the solid leveling ink, and wherein the method further includes fusing the solid leveling ink and the solid colored inks to the base material.

12. The method of claim 9, further comprising printing a removable scratch-off layer over at least a portion of the solid leveling ink and the solid colored inks.

13. An apparatus, comprising a first print engine positioned to print front side information comprising ink of a first color on a base material, wherein the first print engine further comprises a multicolor print head comprising a pile height leveling ink delivery system to print a solid leveling ink of at least a second color to level one or more pile heights associated with the ink of a first color;

a fuser positioned to affix the front side information on the base material; and a second print engine positioned to print a removable scratch-off layer covering at least part of the front side information after the fuser affixes the front side information, wherein the second print engine comprises a solid ink printer.

14. The apparatus of claim 13 wherein the pile height leveling ink delivery system comprises a clear ink delivery system.

15. The apparatus of claim 13 wherein the pile height leveling ink delivery system comprises a white opaque ink delivery system.

16. The apparatus of claim 13, wherein the first print engine is positioned to also print back side information on the base material.

17. The apparatus of claim 13, further comprising a third print engine positioned to print back side information on the base material.

18. The apparatus of claim 17, further comprising a fuser positioned to affix the back side information.

19. The apparatus of claim 13, wherein the first print engine comprises a solid ink printer.

20. The apparatus of claim 17, wherein the third print engine is selected from the group consisting of an offset printer, a direct printer, a laser printer, a solid ink printer, a xerographic printer, and an inkjet printer.

* * * * *